United States Patent [19]

Odle

[11] 4,117,534

[45] Sep. 26, 1978

[54] LUMINAIRE ARRANGEMENT

[75] Inventor: Herbert Arnold Odle, Newark, Ohio

[73] Assignee: Johns-Manville Corporation, Denver, Colo.

[21] Appl. No.: 759,923

[22] Filed: Jan. 17, 1977

[51] Int. Cl.[2] ..... F21V 15/00; F21V 21/00

[52] U.S. Cl. ..... 362/378; 362/344

[58] Field of Search ..... 240/102 R, 102 B, 11.4 R, 240/51.11 R

[56] References Cited

U.S. PATENT DOCUMENTS 1,460,394 7/1923 Tweedy ..... 240/102 R X 2,602,882 7/1952 Wright ..... 240/102 B

*Primary Examiner*—Richard L. Moses

*Attorney, Agent, or Firm*—Robert M. Krone; Joseph J. Kelly; Patricia B. Walker

[57] ABSTRACT

A luminaire arrangement including a guard for protecting a linear light source is disclosed. The guard includes a plurality of wire-like elements. These elements are positioned relative to the linear light source of the luminaire arrangement in such a manner that none of the elements, as defined herein, is coplanar with the light source.

8 Claims, 8 Drawing Figures

LUMINAIRE ARRANGEMENT

BACKGROUND OF THE INVENTION

1. Field of the Invention

The present invention relates in general to a luminaire arrangement and in particular to a guard for protecting a light source of the luminaire arrangement.

2. Description of the Prior Art

In many instances luminaires are employed in locations where it is desirable to protect the luminaire from foreign objects. For example, in school rooms it is often necessary to use a guard in association with the luminaire to avoid paper wads, erasers, and other foreign matter from being thrown into the luminaire.

Heretofore, it has been customary to provide a wire guard for use with such a luminaire. A conventional guard is typically made with radial wire spokes and circumferential wires welded together where the wires cross. The guard is typically positioned such that the circumferential wires circumscribe a portion of the light source or its support. These known guards are useful in a variety of applications, one suitable application being in situations where the luminaire is for indirect lighting. When a light source having a bulb which is coated with a light diffusing material is employed, such known wire guards do not tend to cast sharp distinct shadows on the ceiling. This is because the coated light source acts as a relatively large luminous body, as compared to a point or line source. As such, the light source emits light rays from a relatively large surface area. Hence, if an obstruction which is narrower than the source, e.g. a wire-like element, is positioned in close proximity to the source much of the light will pass beyond the obstruction and illuminate the surface which would otherwise be eclipsed by the obstruction, .i.e., the surface directly behind the element.

Applicant has found, however, that when a long and narrow or thin light source, e.g., a clear linear light having a clear protective bulb with an exposed thin linear arc of light, is used in a luminaire, there may be a shadow problem. More particularly, where an obstructing element is aligned in a common plane with the linear light source, and where the linear light source, i.e., the arc of light is thinner or at least not significantly thicker than the obstruction, light will not pass the obstruction in the manner discussed above. Instead, a very sharp shadow will be cast on the surface illuminated.

If the arc stream of the linear light source is oriented in the vertical direction and is a very fine line of light (e.g. $\frac{1}{8}$ inch or less by $1\frac{3}{4}$ to 4 inches) the arc stream is long enough to bridge across the circumferential wires of a guard circumscribing the source so no appreciable shadow is cast by them. In other words, much of the light from the source will pass behind these circumferential wires to illuminate the area which would otherwise be shadowed. However, if the radial wires are positioned so as to lie within a vertical plane including the arc stream in its entirety, sharp and distinct radial shadows result.

The term "element" as used herein and in the claims refers to any segment of wire-like material in the guard which is capable of lying entirely within at least one plane, i.e., a segment which projects at most in two directions. The thickness of the element, i.e., its cross-sectional dimension, is discounted. Where the element is linear, the element will lie in a plurality of planes. If a segment of wire-like material is three-dimensional (not counting its thickness) then such a segment is considered to include more than one element. That is, even if the segment is a continuous piece of material, if it projects in directions along the X, Y, and Z geometry axes, then the segment is divided into smaller units, i.e., elements, each of which lies within at least one plane.

SUMMARY OF THE INVENTION

An object of the present invention is to provide a luminaire guard which when combined with its associated luminaire does not cast distinct or readily noticeable shadows on a surface which is illuminated.

Accordingly, the luminaire arrangement disclosed herein includes a linear light source and a guard for protecting the light source. The guard which is manufactured in accordance with the present invention includes a plurality of wire-like elements as defined above, none of which is coplanar with the light source. In other words, each element of the guard lies in one or more imaginary planes. These guard elements are positioned relative to the light source such that none of the planes in which the elements lie include the linear light source along its longitudinal length (although their planes will intersect the light source.) This positioning of the elements prevents the guard from casting a heavy distinct shadow on the surface to be illuminated.

In an actual working embodiment of the present invention the guard comprises a plurality of co-axial wire-like circumferential elements having graduated diameters and lying in different imaginary planes. The guard is adapted to be positioned co-axially with the linear light source. Also in accordance with this actual working embodiment, the guard further includes a plurality of wire-like ribs which are circumferentially spaced about and extend outwardly from the circumferential elements. Each of the ribs lies in at least one imaginary plane and is positioned such that none of the planes of any of the ribs is coplanar with the axis of the circumferential wire elements.

DETAILED DESCRIPTION

Figure 1:
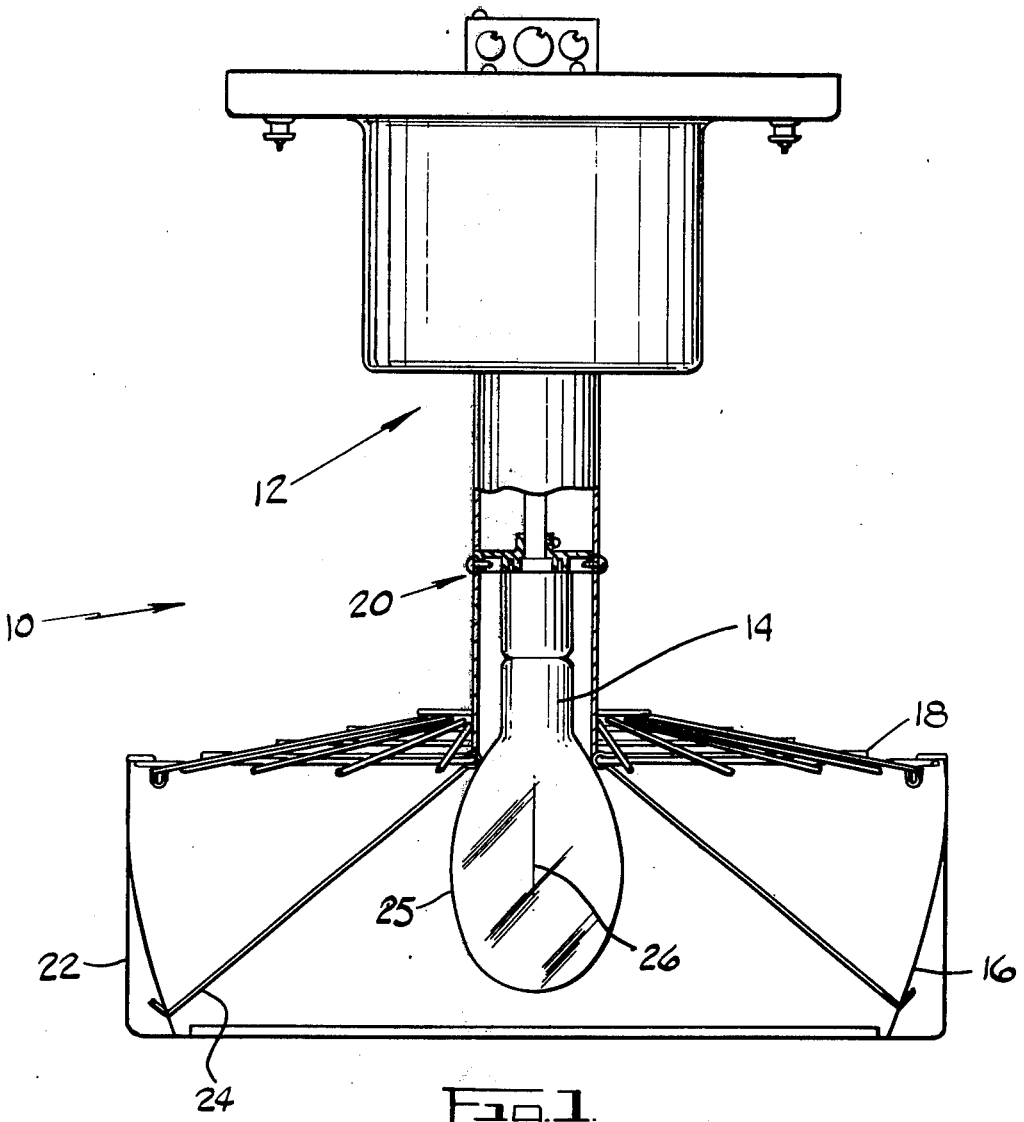
FIG. 1 is an elevational view, partially in section, of a luminaire according to the present invention.

Referring to the drawings, wherein like components are indicated by like reference numerals throughout the figures, FIG. 1 illustrates a luminaire arrangement according to the present invention. As seen in this figure, the arrangement, generally designated by the reference numeral 10, includes a conventional support assembly 12, a linear light source 14, a reflector 16 and a guard 18.

The support assembly 12 can be suitably mounted to any support surface, e.g., a floor, wall or a ceiling area, or the support assembly can be a free-standing support which is readily movable. The assembly may include conventional ballast components if required and it includes a suitable socket arrangement 20 adapted to receive the linear light source 14 and appropriate electrical wiring and associated components (not shown). The support assembly also includes tie bars 24 which are suitably affixed to the socket arrangement 20 and which will support the reflector 16 in position about the light source 14. The tie bars 24 may also directly support a housing 22 around the reflector 16 or the reflector 16 may be fixedly attached directly to the housing 22 such that both the reflector and the housing are supported together by the tie bars 24.

The present invention contemplates utilizing any linear light source 14 so long as it meets certain thickness or width requirements to be discussed below. Where the linear light source has a transparent protective bulb so that the light producing arc is clearly visible, the thickness or width of the source is based on the arc itself, that is, the arc is considered the "light source", at least for purposes of the present invention. However, if the protective bulb is coated to diffuse the light, the thickness or width of the source is based on the bulb, that is, the coated bulb is included as part of the "light source". Examples of light sources suitable for the present invention would include linear high-pressure sodium lamps, mercury lamps and mercury halide lamps. In the embodiment illustrated, the light source 14 includes a transparent protective bulb 25 and a visible linear arc of light 26.

The guard 18 according to the present invention includes a plurality of wire-like elements, each of which lies in one or more imaginary planes. These wire-like elements are positioned in such a way relative to the linear light source 14 such that none of the planes in which the elements lie is coplanar with the linear light source 14, that is, the visible arc 26. As used herein, the term wire-like means a section of material considerably longer than it is thick. The wire-like elements in cross-section may be substantially cylindrical, semi-cylindrical, square, rectangular of any other suitable configuration and they may be relatively straight or curved along their length. The elements may be constructed of metal, e.g., 13-guage steel wire; plastic; or any other suitable material.

In one working embodiment the guard 18 consists of a plurality of circumferential elements 28 having a common axis 34 and a plurality of ribs 30 typically spaced 15° apart about the circumferential elements. The ribs 30 and the circumferential elements 28 are connected together at the points where they intersect one another. Such a guard is particularly suitable for use in a situation where the linear light source is arranged in a vertical direction and the guard 18 is positioned such that the circumferential elements 28 circumscribe a portion of the linear light source (FIG. 1). In order to avoid shadows, the ribs 30 are positioned so as to be substantially off-radial from the axis 34 of the circumferential elements 28 which coincides with the axis of the linear arc of light 26, e.g. by an angle X. In an actual working embodiment, angle X is typically about 20°. The circumferential elements 28 may lie within the same plane or, as illustrated, they may be tiered over a distance Y, e.g. 10°.

Figure 2:
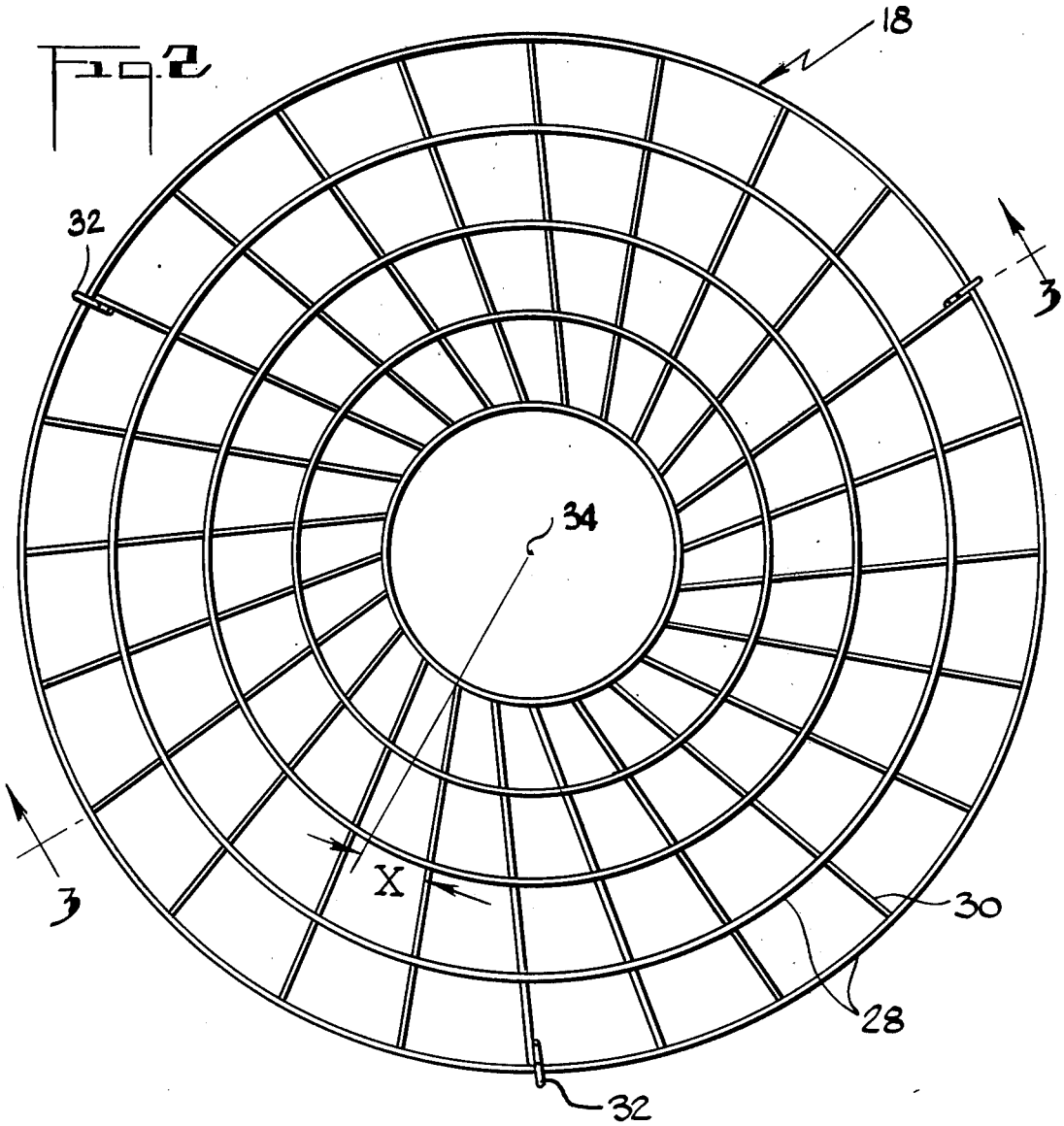
FIG. 2 is a plan view of a guard used in the arrangement of FIG. 1 and constructed according to the present invention.
Figure 3:
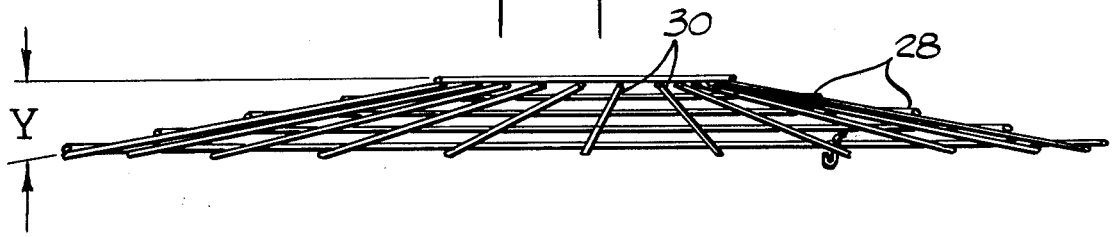
FIG. 3 is a cross-sectional view taken generally along line 3—3 in FIG. 2.

It should be noted, that the circumferential elements 28 need not be circular as shown in FIG. 2, but could in fact have other configurations, e.g., square, oval, etc. Furthermore, the ribs 30 need not be continuous pieces which extend from the inner circumferential element to the outer circumferential element but may in fact form some type of staggered grid pattern. A suitable means for supporting the guard can be supplied which is a nonintegral component of the guard or integral support elements, e.g. support ribs 32, can be included as a part of the guard which permit easy attachment of the guard to the support assembly 12 and to the housing 22.

However, it is important to maintain the guard elements, e.g. the circumferential elements and ribs or other suitable arrangements, in the above-described relative position with the light source. As stated previously, if any guard element is positioned such that it lies within a plane which includes the linear light source, in its entirety, a sharp distinct shadow results.

Figure 4:
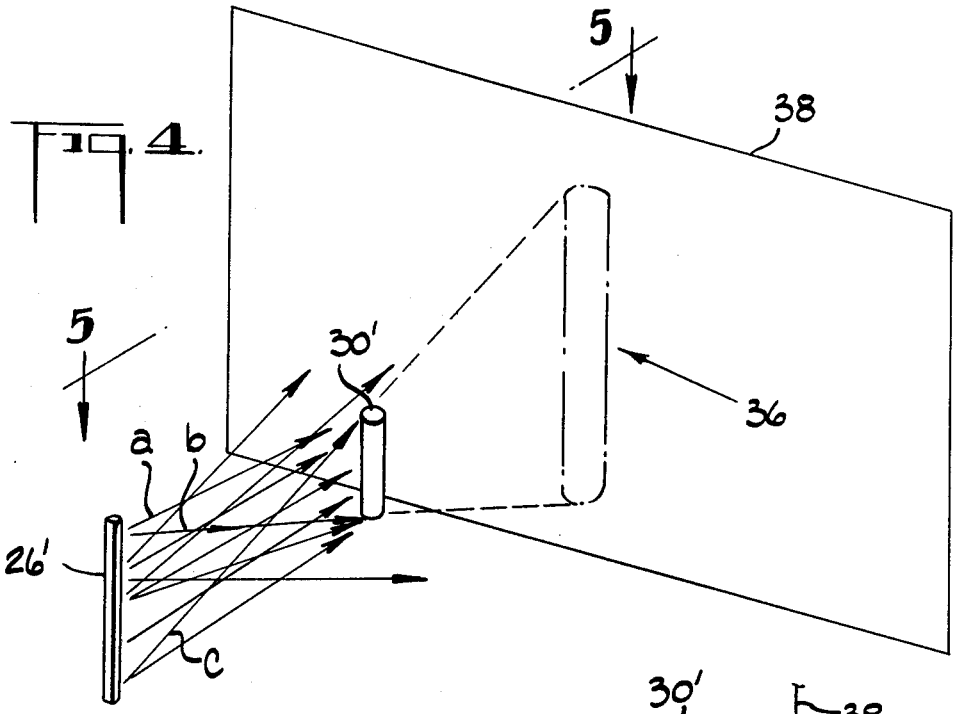
FIG. 4 is a schematic perspective which illustrates the shadowing problem discussed herein.
Figure 5:
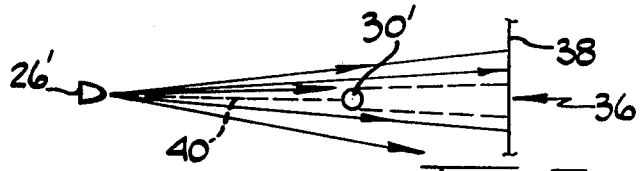
FIG. 5 is a view taken generally along line 5—5 in FIG. 4.

FIG. 4 illustrates a linear arc source 26' which emits a plurality of light rays, e.g., rays *a, b,* and *c.* Depending on their direction, these light rays impinge on or pass by a portion of a guard element 30' which is approximately as thick as or thicker than source 26'. As illustrated best in FIG. 5, the guard element is positioned relative to the source such that both, in their entirety, lie in a common plane, specifically plane 40, indicated by a dotted line in FIG. 5. Due to this thickness relationship and this positioning relationship, a sharp distinct shadow 36 is cast on surface 38 which is located behind element 30'. More specifically, while most of the surface 38 is illuminated by the light rays passing to one side of element 30', this element blocks the light rays which are directed towards it and along the common plane 40. As can be seen in FIG. 5 no light rays pass to a point directly behind the element. This causes the shadow area 36 to appear on surface 38. Since source 26' and element 30' are in the same plane and since the light source is not significantly wider than the element, light from this source cannot reach the shadowed area to brighten up this area and reduce this shadow effect.

Figure 6:
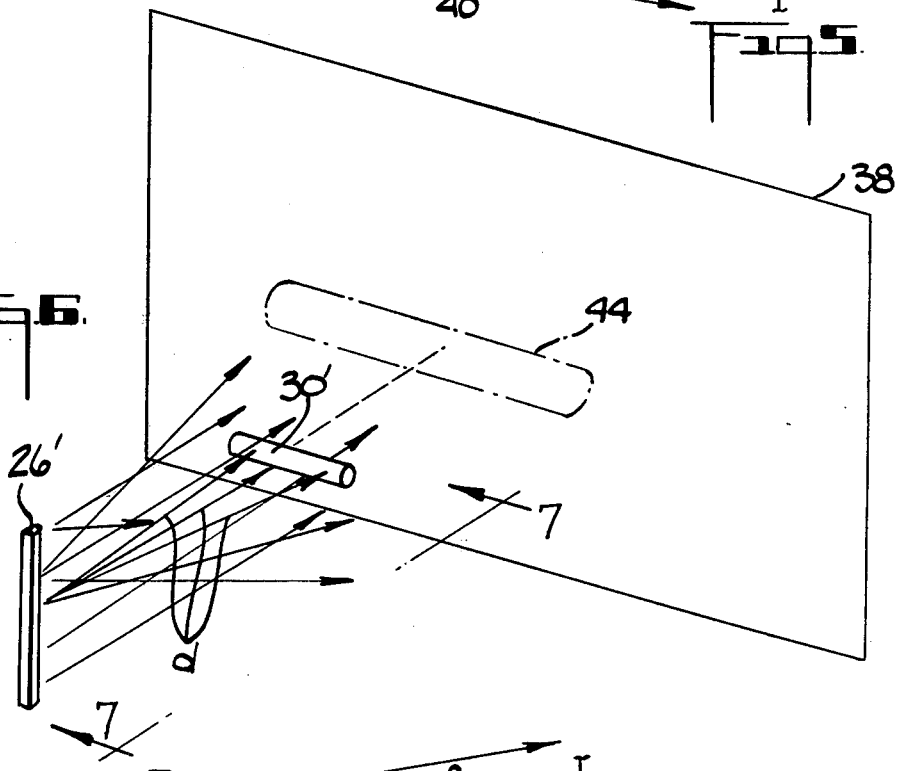
FIG. 6 is a schematic perspective illustrating the lighting effect obtained in accordance with the present invention.
Figure 7:
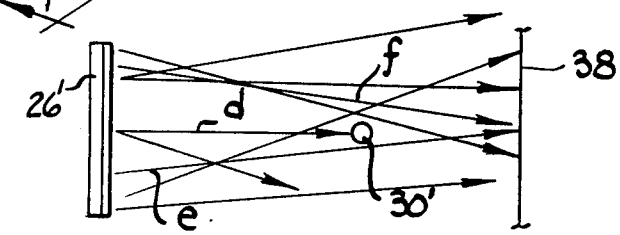
FIG. 7 is a view taken generally along line 7—7 in FIG. 6.

FIGS. 6 and 7 illustrate how this shadowed area 42 may be substantially reduced and in effect eliminated. As seen in these figures, element 30' has been shifted so that it no longer lies in the common plane 40. For purposes of illustration, the element has been shifted 90° so that it is now horizontal (while the source 26' remains vertical). Notwithstanding this shift, element 30' still prevents a certain amount of light from reaching surface 38, specifically that light impinging the front face of element 30', indicated by rays *d.* This produces a shadowed area 44 indicated by dotted lines in FIG. 6. However, as illustrated in FIG. 7, since the source 26' and the element 30' are not in common plane, those segments of the source outside the plane emit rays, for example rays *e* and *f,* which pass to one side of the element and illuminate the area 44, thereby reducing its shadowed appearance. With this area sufficiently illuminated by rays passing to one side of element 30', specifically rays *e* and *f,* the shaded area may be eliminated, at least to the naked eye. This can be accomplished whether the element 30' is shifted 90° as illustrated or whether it is merely shifted so as to lie just outside the otherwise common plane 40. So long as there is sufficient light from the source 26' reaching the area 44, the element is considered to be positioned in accordance with the present invention.

Figure 8:
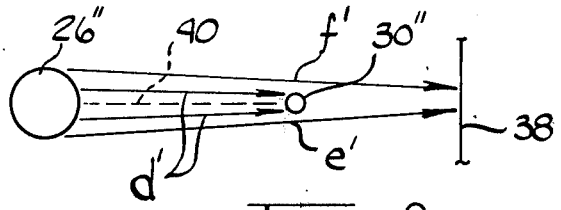
FIG. 8 is a view similar to FIG. 5 using a different light source.

It should be noted that the foregoing situations illustrated in FIGS. 4–7 exist when the source 26′ is not significantly thicker than element 30′. If the source is, in fact, significantly thicker than the element 30′ then the source and the element could be in a common plane and yet no visible shadow will result. As illustrated in FIG. 8, a light source 26″ and guard element 30″ lie in the common plane 40. The element 30″ prevents light rays *d′* from reaching the surface 38. However, since the source 26″ is significantly thicker than the element 30″, light rays *e′ f′* pass to one side of the element to light up the area of surface 38 which would otherwise be shadowed by the element 30″. Therefore, where the light source is thicker than the guard elements there is generally no problem with shadows, even if the source and elements are coplaner.

What is claimed is:

1. A luminaire arrangement comprising:
(a) a guard for protecting a light source, said guard including a plurality of wire-like elements;
(b) a linear light source having a thickness substantially equal to or less than the thickness of the wire-like elements;
(c) means for supporting said light source and said guard in a way which positions said guard elements relative to said linear light source such that none of the elements is coplanar with said linear light source,
(d) said guard elements including at least one circumferential element and a plurality of spoke-like elements circumferentially spaced about and extending outwardly from said circumferential element.

2. A luminaire arrangement according to claim 1 wherein said elements include a plurality of wire-like circumferential elements which have a circular configuration and which have an imaginary common axis and graduated diameters, said circumferential elements being positioned such that said axis coincides with the linear light source and a plurality of spoke-like elements extending outwardly from at least one of the circumferential elements.

3. A luminaire arrangement according to claim 2 wherein all of said circumferential elements do not lie within the same imaginary plane.

4. A guard for a luminaire arrangement comprising a plurality of wire-like elements at least one of which is a circumferential element having an imaginary axis and a plurality of ribs which are circumferentially spaced about and extend outwardly from said circumferential element, said ribs being positioned such that none of said ribs intersects said axis.

5. A guard according to claim 4 including a plurality of circumferential elements having a common axis and having graduated diameters, wherein all of said circumferential elements do not lie within the same imaginary plane.

6. A luminaire arrangement comprising:
(a) a guard for protecting a light source, said guard including a plurality of wire-like elements, wherein said elements include a plurality of circumferential elements having an imaginary common axis and having graduated diameters, said circumferential elements being positioned such that the common axis coincides with the linear light source and such that each circumferential element lies within a different imaginary plane and a plurality of spoke-like elements extending outwardly from at least one of the wire-like circumferential elements;
(b) a linear light source having a thickness substantially equal to or less than the thickness of the wire-like elements;
(c) means for supporting said light source and said guard, said guard elements being positoned relative to said linear light source such that none of said elements is coplanar with said linear light source;
(d) a reflector and means for supporting said reflector.

7. A luminaire arrangement according to claim 6 wherein said linear light source is pendant and oriented in the vertical direction, said reflector being supported beneath said linear light source and comprising an upwardly flaring bowl-like means having an outer rim.

8. A luminaire arrangement according to claim 7 wherein said guard is interposed between said light source and the rim of said reflector.

* * * * *